US009623306B1

(12) United States Patent
Walker

(10) Patent No.: US 9,623,306 B1
(45) Date of Patent: Apr. 18, 2017

(54) ATHLETIC TRAINING NET

(71) Applicant: Walker Sports Innovations, LLC, Clearwater, FL (US)

(72) Inventor: John David Walker, Clearwater, FL (US)

(73) Assignee: WALKER SPORTS INNOVATIONS, LLC, Clearwater, FL (US)

( * ) Notice: Subject to any disclaimer, the term of this patent is extended or adjusted under 35 U.S.C. 154(b) by 0 days.

(21) Appl. No.: 15/097,982

(22) Filed: Apr. 13, 2016

Related U.S. Application Data

(60) Provisional application No. 62/253,756, filed on Nov. 11, 2015.

(51) Int. Cl.
*A63B 63/00* (2006.01)
*A63B 69/00* (2006.01)
*A63B 71/02* (2006.01)

(52) U.S. Cl.
CPC ..... *A63B 63/00* (2013.01); *A63B 69/00* (2013.01); *A63B 71/022* (2013.01); *A63B 2063/006* (2013.01); *A63B 2210/50* (2013.01)

(58) Field of Classification Search
CPC ..... A63B 71/022; A63B 2063/006; A63B 2210/50
USPC ..... 473/197, 439, 451, 462, 494, 476–478, 473/454–456, 435, 446, 473, 474; 273/398–402
See application file for complete search history.

(56) References Cited

U.S. PATENT DOCUMENTS 3,810,616 A 5/1974 Murphy
4,118,028 A * 10/1978 Larkin ..... A63B 63/00 273/394
4,153,246 A * 5/1979 Byrne ..... A63B 63/00 160/113
4,183,524 A * 1/1980 Kifferstein ..... A63B 63/00 473/197
5,000,461 A * 3/1991 Borazjani ..... A63B 63/00 273/400
5,007,645 A * 4/1991 Weigl ..... A63B 63/00 273/407
5,037,095 A * 8/1991 Nedwick ..... A63B 63/00 273/400
5,116,056 A * 5/1992 Schmutte ..... A63B 63/00 160/330

(Continued)

*Primary Examiner* — Mark Graham
(74) *Attorney, Agent, or Firm* — Nicholas Pfeifer; Smith & Hopen, P.A.

(57) ABSTRACT

An athletic training net for receiving projectiles. The training net has a storage sleeve affixed to an upper end, wherein the storage sleeve includes a plurality of upper grommets at an upper end and a plurality of lower grommets at a lower end. The training net further includes a plurality of hook and strap fasteners, with each comprising of a strap secured to a structural member of a garage door and a hook for catching the plurality of upper and lower grommets. The training net has a training configuration and a storage configuration. In the training configuration, the hooks are received by the plurality of upper grommets and the net is vertically suspended form the garage door. In the storage configuration, the plurality of upper grommets remains suspended from the hooks, the net is enfolded in the storage sleeve, and the plurality of lower grommets is secured by the hooks.

18 Claims, 6 Drawing Sheets

(56) References Cited

U.S. PATENT DOCUMENTS 5,205,564 A * 4/1993 Lamberti ..... A63B 71/022 273/400
5,306,009 A * 4/1994 Bolanos ..... A63B 63/00 473/157
5,516,115 A * 5/1996 McLain ..... A63B 63/00 273/354
5,527,032 A * 6/1996 Coleman ..... A63B 63/00 273/410
5,571,266 A 11/1996 Nichols
5,722,905 A * 3/1998 Bidelman ..... A63B 71/022 273/400
5,725,444 A 3/1998 Heden
5,876,291 A 3/1999 Dubose
5,947,831 A * 9/1999 McCarthy ..... A63B 63/00 473/197
5,993,334 A * 11/1999 McNamara ..... A63B 63/00 473/446
6,189,889 B1 * 2/2001 Yip ..... A63B 63/00 273/348
6,283,876 B1 * 9/2001 Northcutt ..... A63B 47/002 473/422
6,969,068 B1 * 11/2005 Pollon ..... A63B 63/00 273/400
7,293,776 B2 11/2007 Fenwick
8,246,494 B2 * 8/2012 Stephenson ..... A63B 63/004 473/422
9,174,107 B2 * 11/2015 Dettor ..... A63B 61/00
9,289,673 B1 * 3/2016 Allen ..... A63B 71/022
2003/0125121 A1 * 7/2003 Rhee ..... A63B 63/00 473/195
2010/0081513 A1 * 4/2010 La Pointe ..... A63B 63/00 473/197
2012/0270670 A1 10/2012 Kunkle
2012/0322567 A1 * 12/2012 Manieri ..... A63B 69/36 473/151
2014/0171230 A1 * 6/2014 Candello ..... A63B 69/0002 473/456

* cited by examiner

ATHLETIC TRAINING NET

CROSS-REFERENCE TO RELATED APPLICATIONS

This nonprovisional application is a continuation of and claims priority to provisional application No. 62/253,756, entitled "Garage Sports Net," filed Nov. 11, 2015 by the same inventor.

BACKGROUND OF THE INVENTION

1. Field of the Invention

This invention relates, generally, to an athletic training device. More specifically, it relates to an athletic training net adapted to suspend from a garage door.

2. Brief Description of the Prior Art

Year round athletic training, particularly in baseball and softball, is a necessity for maximizing an athlete's potential to compete at the highest level. Consistent year round training, however, can be difficult to maintain given the changes in weather and the high cost and low availability of indoor training facilities. In addition, it can be difficult for athletes with a busy schedule to find time to travel to training facilities and travel times inherently take away from training time.

Currently, there exist several athletic training devices for providing at home training. Some examples include U.S. Pat. No. 5,725,444, U.S. Pat. No. 7,293,776, U.S. Pat. No. 5,876,291, and U.S. Pat. No. 5,571,266. Each of these patents discloses a training device suspended to a garage door or a garage door opening and several include a plurality of pockets/sleeves for receiving and securing a ball or similar sports object. Hereinafter a ball or similar sports object will be collectively referred to as a "projectile." Each of these training devices, however, fails to disclose a simple, inexpensive, and easy to use storage sleeve affixed to both an upper end of the training device and a garage door.

Accordingly, what is needed is a training net having a simple, inexpensive, and easy to use storage sleeve adapted to affix to the inside of a garage door. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a training net having a simple, inexpensive, and easy to use storage sleeve adapted to affix to the inside of a garage door is now met by a new, useful, and nonobvious invention.

The novel structure includes a net having lower end and an upper end with a height extending therebetween, a pair of sides with a width extending therebetween, and a storage sleeve affixed to the upper end of the net. The storage sleeve has an upper end with a plurality of grommets disposed therein. Each upper grommet is aligned about a first horizontal axis. The lower end, likewise, has a plurality of lower grommets with each lower grommet aligned about a second horizontal axis. In addition, at least two of the upper grommets are vertically aligned with a lower grommet.

In an embodiment, the upper end of the training net is secured to the storage sleeve between the plurality of upper and lower grommets.

The present invention further includes a plurality of hook and strap fasteners. Each strap is secured around a structural member of a garage door and each hook is received by one of the plurality of upper grommets. In a training configuration, the training net is suspended vertically from the garage door by releasing the lower grommets from the hooks while the upper grommets remain suspended from the hooks. In a storage configuration, the hooks catch both the upper and lower grommets when the training net is enfolded in the storage sleeve.

In an embodiment, the storage sleeve has a width greater than or equal to the width of the training net, such that the entire net can be enfolded in the storage sleeve. In an embodiment, the storage sleeve is comprised of a smooth outer surface to prevent objects from catching on the storage sleeve when secured in the storage configuration.

In an embodiment, the net includes a receiving pocket having a bag-like shape for catching projectiles that pass into the receiving pocket.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention is an athletic training net having a simple, inexpensive, and easy to use storage sleeve adapted to affix preferably to the inside of a garage door. The storage sleeve allows the net to be secured to the garage door indefinitely without hindering the intended operation of the garage door. The training net easily and quickly transitions between a storage orientation and training orientation allowing an athlete to maximize his/her training time.

Figure 1:
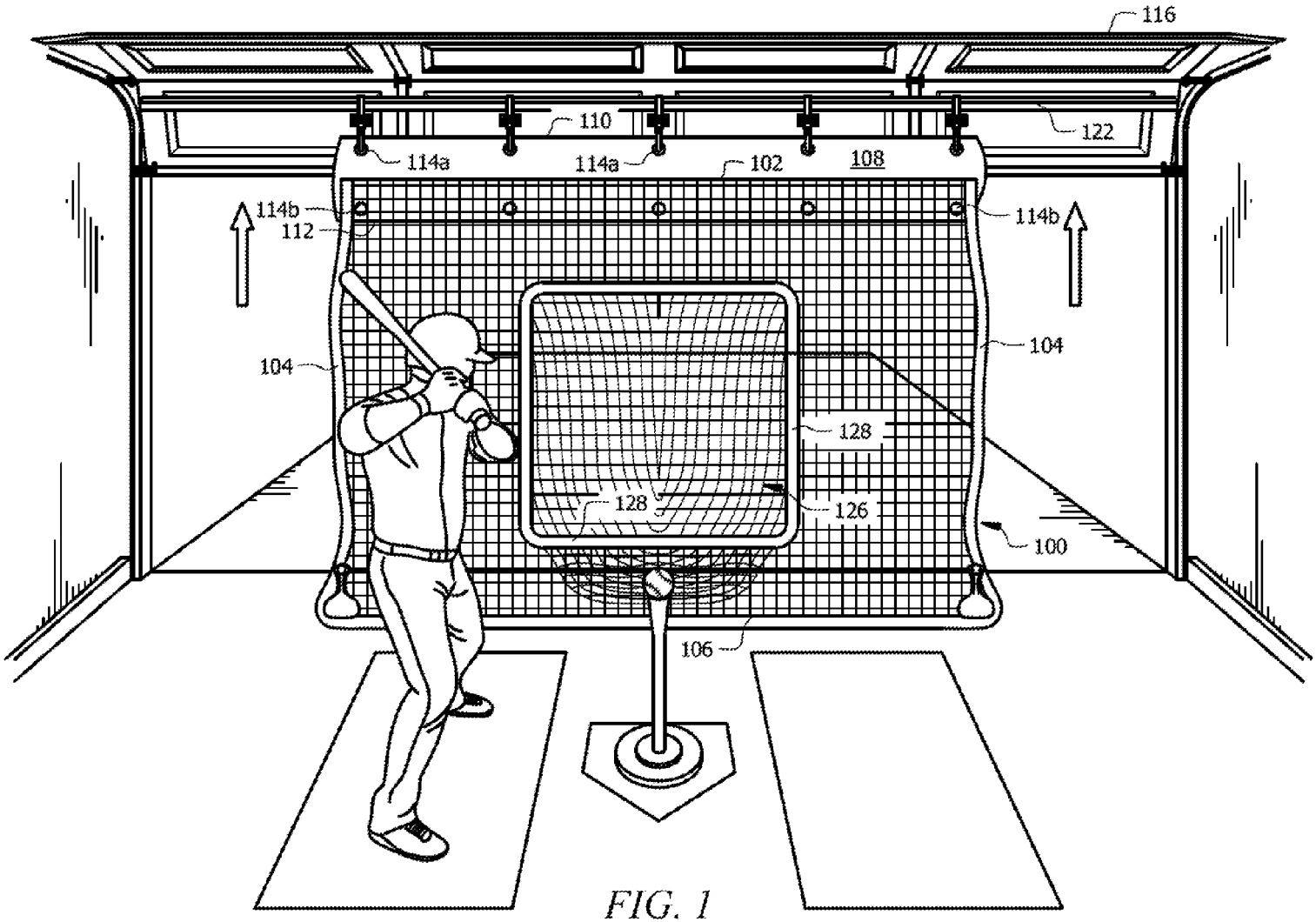
FIG. 1 depicts an embodiment of the present invention wherein the training net is suspended from the garage door when the garage door is in an open configuration.
Figure 2:
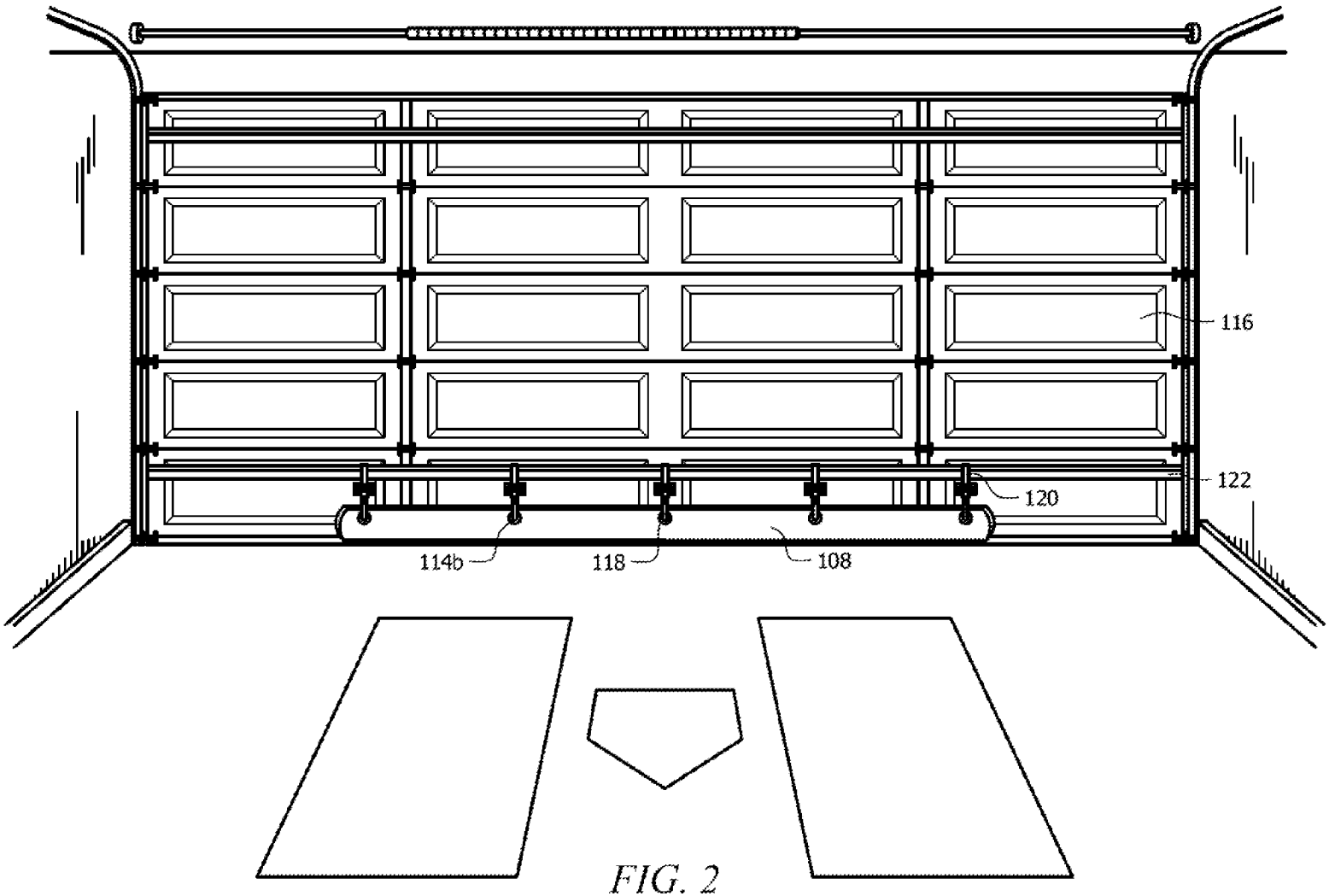
FIG. 2 depicts an embodiment of the present invention wherein the training net is secured within the storage sleeve.

As depicted in FIG. 1, an exemplary embodiment of the training net is generally denoted by reference numeral 100. Net 100 has a generally rectangular shape comprised of upper end 102, sides 104, and lower end 106. Upper end 102 includes storage sleeve 108, which is adapted to be secured to garage door 116. When garage door 116 is opened, as shown in FIG. 1, storage sleeve 108 can be opened to release net 100. Net 100 suspends from garage door 116 allowing, as shown in FIG. 1, a baseball player to hit baseballs into net 100. When finished training, the user can simply lower garage door 116, roll net 100 into storage sleeve 108, and secure sleeve 108 to garage door 116, as is shown in FIG. 2.

Referring back to FIG. 1, storage sleeve 108 includes upper end 110 and lower end 112. Both ends 110, 112 include a plurality of grommets 114*a*, 114*b* disposed therein. Upper grommets 114*a* are preferably equidistantly spaced from each another and aligned horizontally along the width of storage sleeve 108. Likewise, lower grommets 114*b* are preferably equidistantly spaced from each another and aligned horizontally along the width of storage sleeve 108. The embodiment in FIGS. 1-2 includes 5 upper grommets 114*a* and five lower grommets 114*b*, however, any number of grommets may be used so long as the weight of net 102 is appropriately distributed to prevent tearing of grommets 114*a*, 114*b* from storage sleeve 108.

Upper grommets 114*a* and lower grommets 114*b* are vertically spaced inwardly, towards the longitudinal axis of storage sleeve 108, from their respective ends 110, 112. In an embodiment, upper and lower grommets 114*a*, 114*b* are spaced an equal distance from their respective upper and lower ends 110, 112.

Storage sleeve 108 is preferably permanently integrated into upper end 102, however, it is considered that upper end 102 may be temporarily secured to storage sleeve 108. Upper end 102 is secured to storage sleeve 108 between upper and lower grommets 114*a*, 114*b*. This attachment location enables the entirety of net 100 to be located between grommets 114*a*, 114*b* when net 100 is rolled into storage sleeve 108. As a result, net 100 does not interfere with hooks 118 when received by grommets 114*a*, 114*b* in the storage configuration.

Storage sleeve 108 preferably includes a width that extends at least as wide as the width of net 100. If viewing FIG. 1, the width of net 100 extends between sides 104. By having a width greater than or equal to the width of net 100, sleeve 108 can fully enfold net 100 and prevent net 100 from catching on any objects that might contact storage sleeve 108 when net 100 is fully enfolded in storage sleeve 108. For the same reason, storage sleeve 108 is made of a smooth preferably impermeable material, such as a two-ply vinyl fabric. The two-ply fabric provides additional durability while still remaining pliable for attaching to the net. The vinyl fabric includes the added benefits of being durable, inexpensive to manufacture, easy to clean, and odor resistant.

The present invention further includes a series of hook and strap fasteners for securing storage sleeve 108 to garage door 116. Each hook and strap fastener includes hook 118 and strap 120. Straps 120 are secured to a structural member of garage door 116 while hooks 118 catch grommets 114*a*. As shown in FIG. 1, upper grommets 114*a* are intended to remain secured by hooks 118 when net 100 is suspended from garage door 116. As shown in FIG. 2, lower grommets 114*b* also receive hooks 118 when net 100 is enfolded into storage sleeve 108 and stored for future use.

Figure 3:
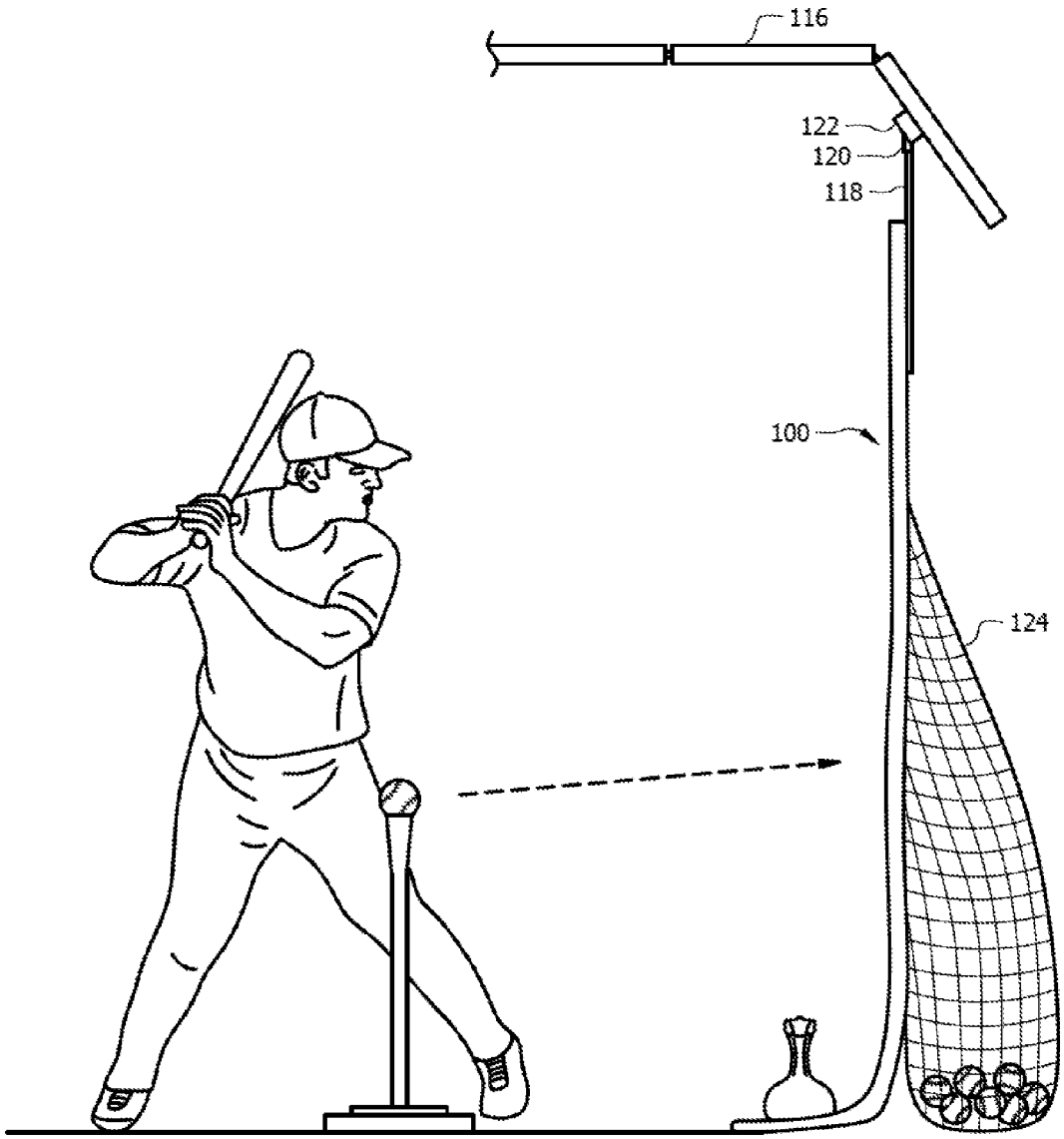
FIG. 3 is a side view of the invention as depicted in FIG. 1.
Figure 4:
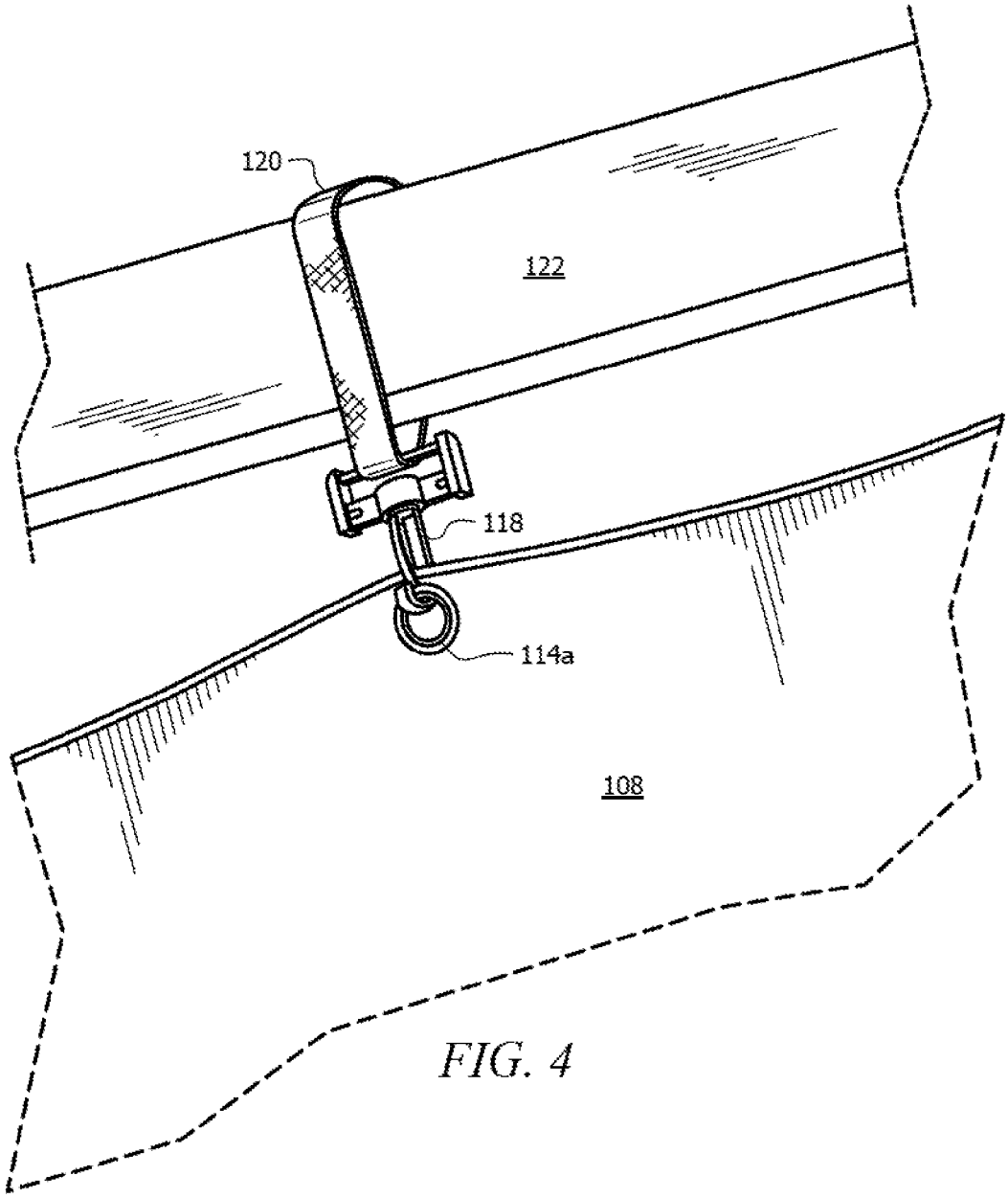
FIG. 4 is a close-up view of an embodiment of the storage sleeve secured to a horizontal support member on a garage door.

As shown most clearly in FIG. 3, an embodiment includes strap 120 secured to a horizontal structural member 122, such as a horizontal hurricane brace, on garage door 116. Strap 120, however, is versatile enough to be attached to any structural member of garage door 116. For example, the embodiment shown in FIG. 5 includes strap 120 secured to roller mechanism 130.

Strap 120 is preferably a hook and loop fastener so that a user can easily attach strap 120 to garage door 116 without having to permanently modify garage door 116. An embodiment may use other known attachment devices, but it is particularly advantageous to use an easily attachable fastener that does not require any permanent alterations to the existing garage structure.

In an embodiment, strap 120 may be secured to any structural member, however, it is desirable to secure strap 120 to a structural member that can be lowered to allow a user to more easily roll net 100 into sleeve 108.

Referring to FIGS. 1 and 3, net 100 further includes receiving pocket/sleeve 124. As most easily seen in FIG. 3, receiving pocket 124 extends out of the backside of net 100 and acts as a closed pouch for gathering baseballs or other similar projectiles that pass into pocket 124. Receiving pocket 124 includes opening 126 in net 100, which can be generally located in the center of the front side of net 100 as shown in FIG. 1. In an embodiment, opening 126 includes visible border 128 to easily distinguishing opening 126 from the rest of net 100. As a result, the athlete is provided with a visible target.

Figure 5A:
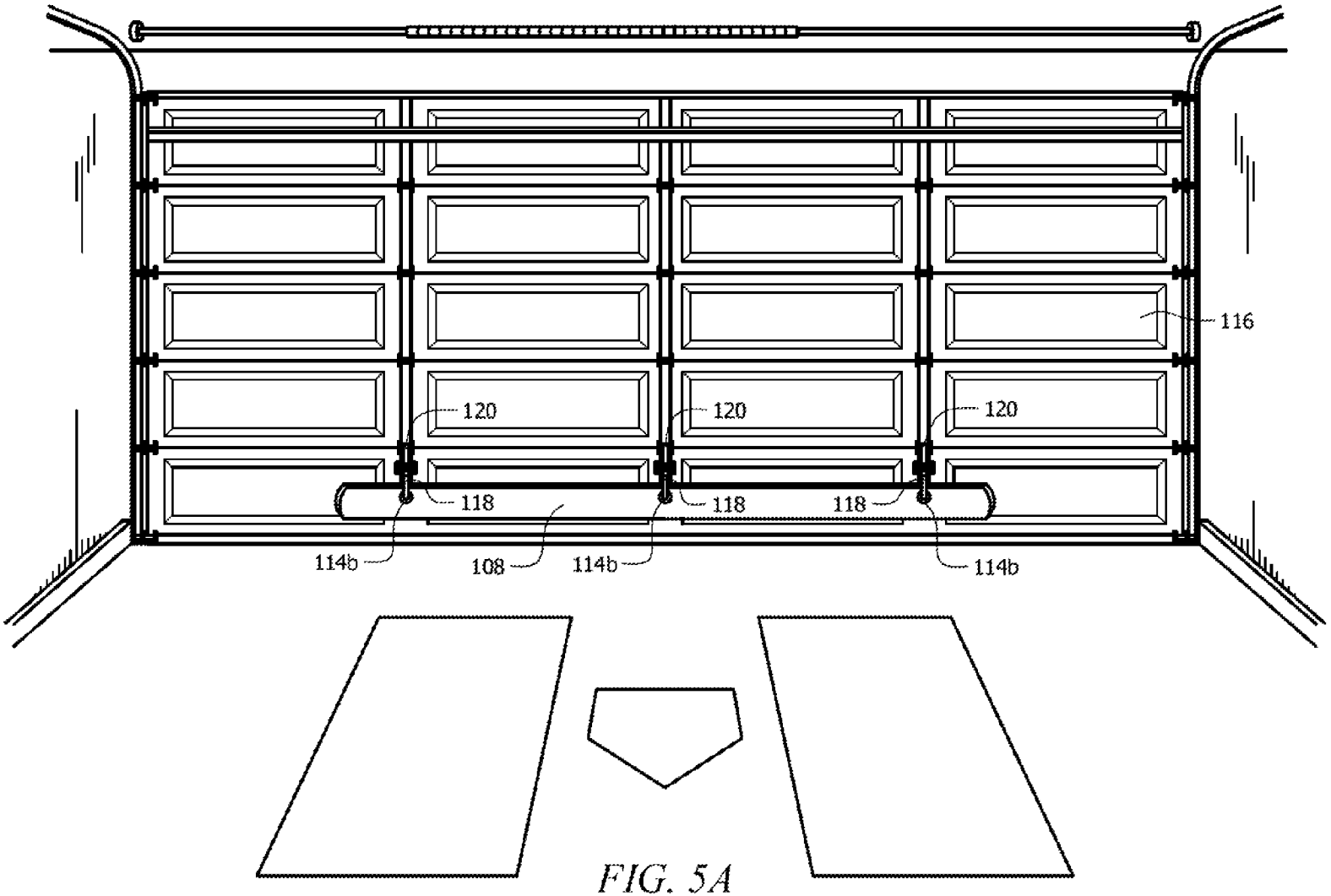
FIG. 5A depicts an embodiment of the present invention wherein the training net is secured within the storage sleeve.
Figure 5B:
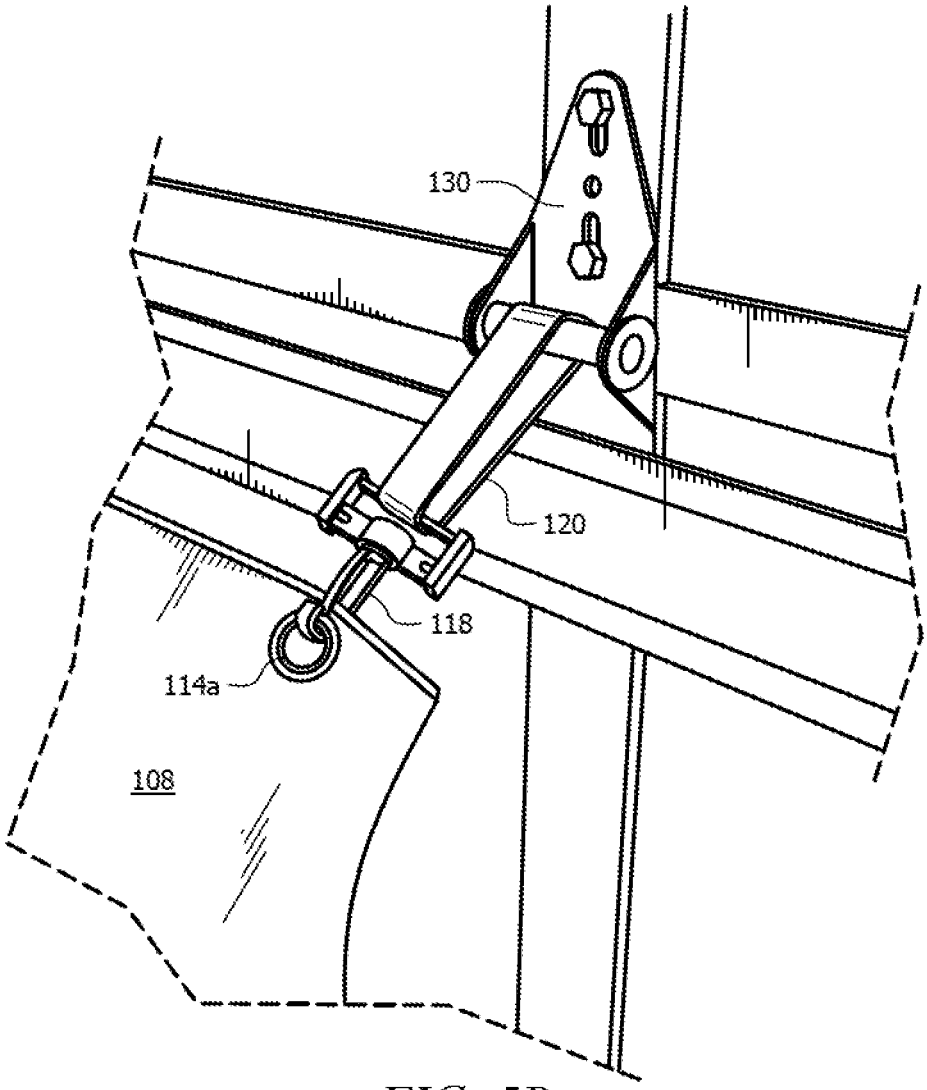
FIG. 5B is a close-up view of an embodiment of the storage sleeve secured to a roller mechanism on a garage door.

Referring now to FIGS. 5A-5B, an embodiment includes three upper grommets 114*a* and three lower grommets 114*b*. Each of upper grommets 114*a* are laterally spaced roughly forty-six inches with respect to each other, and each of lower grommets 114*b* are similarly spaced. This spacing ensures that grommets 114*a*, 114*b* are vertically aligned with roller mechanisms 130 found on a typical two-car garage door 116. Certain garage doors do not have horizontal hurricane braces, but a majority of new garage doors include roller mechanisms 130, which enable the garage door to separate and transition between an opened and closed position. This three-grommet design and spacing allows the storage sleeve to attach to either horizontal bracing 122 or rollers mechanisms 130.

An embodiment may also include additional fasteners located on the upper and lower ends of the storage sleeve, such as hook and loop fasteners. The additional fasteners allow the storage sleeve to more fully enclose and secure the training net when in the storage configuration.

Glossary of Claim Terms

Grommet: is a ring made of a stronger material than a surrounding fabric, such as metal or plastic, that is used to strengthen a small hole in the fabric. While grommets are typically ring shaped, it is considered that the grommets may have other shapes so long as the hole in the fabric is reinforced.

Hook: is a structural member that is curved or bent back at an angle for catching hold of or hanging things thereon.

Net: is a fabric barricade.

Strap: is a strip of material used to fasten, secure, or hold onto something.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An athletic training net, comprising:

a lower end and an upper end with a height extending therebetween;

a pair of sides with a width extending therebetween;

a storage sleeve affixed to the upper end of the net, wherein the storage sleeve further includes:

an upper end having a plurality of grommets, wherein each upper grommet is aligned about a first horizontal axis;

a lower end having a plurality of lower grommets, wherein each lower grommet is aligned about a second horizontal axis;

at least two of the upper grommets vertically aligned with a lower grommet; and the upper end of the training net secured to the storage sleeve between the plurality of upper and lower grommets.

2. The training net of claim 1, wherein the storage sleeve has a width greater than or equal to the width of the training net.

3. The training net of claim 1, further including a plurality of hook and strap fasteners, wherein each strap is secured around a structural member of a garage door and each hook is received by one of the plurality of upper grommets.

4. The training net of claim 1, further including a receiving pocket having a bag-like shape for catching projectiles that pass into the receiving pocket.

5. The training net of claim 3, further including a training configuration wherein the plurality of upper grommets remains secured by the plurality of hooks while the plurality of lower grommets is unengaged from the plurality of hooks, thereby allowing the training net to suspend vertically from the garage door.

6. The training net of claim 1, further including a storage configuration wherein the training net is enfolded in the storage sleeve by securing both the plurality of upper grommets and the plurality of lower grommets with the plurality of hooks.

7. The training net of claim 1, wherein the storage sleeve is comprised of a smooth outer surface.

8. The training net of claim 1, where the first horizontal axis is vertically spaced downwardly from the upper end of the storage sleeve by a first predetermined distance, the second horizontal axis is vertically spaced upwardly from the lower end of the storage sleeve by a second predetermined distance, and the first predetermined distance equates to the second predetermined distance.

9. An athletic training net, comprising:

a lower end and an upper end with a height extending there between;

a pair of sides with a width extending there between;

a storage sleeve affixed to the upper end of the net, wherein the storage sleeve further includes:

an upper end having a plurality of grommets, wherein each upper grommet is aligned about a first horizontal axis;

a lower end having a plurality of lower grommets, wherein each lower grommet is aligned about a second horizontal axis;

at least two of the upper grommets vertically aligned with a lower grommet; and a plurality of hook and strap fasteners, wherein each strap is secured around a structural member of a garage door and each hook is received by one of the plurality of upper grommets.

10. The training net of claim 9, wherein the storage sleeve has a width greater than or equal to the width of the training net.

11. The training net of claim 9, further including a receiving pocket having a bag-like shape for catching projectiles that pass into the receiving pocket.

12. The training net of claim 9, further including a training configuration wherein the plurality of upper grommets remains secured by the plurality of hooks while the plurality of lower grommets is unengaged from the plurality of hooks, thereby allowing the training net to suspend vertically from the garage door.

13. The training net of claim 9, further including a storage configuration wherein the training net is enfolded in the storage sleeve by securing both the plurality of upper grommets and the plurality of lower grommets with the plurality of hooks.

14. The training net of claim 9, wherein the storage sleeve is comprised of a smooth outer surface.

15. An athletic training net, comprising:

a lower end and an upper end with a height extending therebetween;

a pair of sides with a width extending there between;

a storage sleeve affixed to the upper end of the net, wherein the storage sleeve further includes:

an upper end having a plurality of grommets, wherein each upper grommet is aligned about a first horizontal axis;

a lower end having a plurality of lower grommets, wherein each lower grommet is aligned about a second horizontal axis;

at least two of the upper grommets vertically aligned with a lower grommet;

the upper end of the training net secured to the storage sleeve between the plurality of upper and lower grommets;

a plurality of hook and strap fasteners, wherein each strap is secured around a structural member of a garage door and each hook is received by one of the plurality of upper grommets;

a training configuration wherein the plurality of upper grommets remains secured by a plurality of hooks while the plurality of lower grommets is unengaged from the plurality of hooks, thereby allowing the training net to suspend vertically from the garage door; and a storage configuration wherein the training net is enfolded in the storage sleeve by securing both the plurality of upper grommets and the plurality of lower grommets with the plurality of hooks.

16. The training net of claim 15, wherein the storage sleeve has a width greater than or equal to the width of the training net.

17. The training net of claim 15, further including a receiving pocket having a bag-like shape for catching projectiles that pass into the receiving pocket.

18. The training net of claim 15, wherein the storage sleeve is comprised of a smooth outer surface.

* * * * *